United States Patent [19]

Murphy

[11] Patent Number: 4,672,787

[45] Date of Patent: Jun. 16, 1987

[54] WALL SYSTEM CONSTRUCTION, PARTS AND METHODS OF ASSEMBLY

[76] Inventor: John J. Murphy, P.O. Box 886, Valley Forge, Pa. 19481-0886

[21] Appl. No.: 791,254

[22] Filed: Oct. 25, 1985

[51] Int. Cl.[4] ..... E04B 1/60; E04B 1/64

[52] U.S. Cl. ..... 52/409; 52/417; 52/746; 52/747; 52/764

[58] Field of Search ..... 52/408–411, 52/309.8, 309.9, 169.14, 417, 515, 516, 274, 293, 764, 746, 747

[56] References Cited

U.S. PATENT DOCUMENTS

| | | | |
|---|---|---|---|
| 1,669,730 | 5/1928 | Walper | 52/417 |
| 2,139,461 | 12/1938 | Pride | 52/274 |
| 3,041,219 | 6/1962 | Steck | 52/409 |
| 3,312,585 | 4/1967 | Hamme | 52/516 |
| 3,332,193 | 7/1967 | Elmendorf et al. . | |
| 3,362,120 | 1/1968 | Warren et al. . | |
| 3,381,436 | 5/1968 | Elliott et al. . | |
| 3,443,349 | 5/1969 | Mahle et al. . | |
| 3,474,584 | 10/1969 | Lynch et al. . | |
| 3,475,261 | 10/1969 | Ettore et al. . | |
| 3,576,091 | 4/1971 | Schull, Jr. et al. . | |
| 3,581,779 | 6/1971 | Sylvia, Jr. et al. . | |
| 3,654,053 | 4/1972 | Toedter et al. . | |
| 3,812,635 | 5/1974 | Hala et al. . | |
| 4,021,981 | 5/1977 | Van Wagoner et al. . | |
| 4,052,831 | 10/1977 | Roberts et al. . | |
| 4,201,025 | 5/1980 | Williamson et al. . | |

FOREIGN PATENT DOCUMENTS

| | | | |
|---|---|---|---|
| 585186 | 10/1945 | United Kingdom | 52/417 |

OTHER PUBLICATIONS

1982 Sweet's Catalog entitled "Products for General Building", Index Sections 7.9, 7.11.

Article Entitled, "Brick Veneer: A Second Opinion", C. T. Grimm, The Construction Specifier, Apr. 1984.

Article Entitled, "Design Alert #8 Brick Veneer Steel Stud Design Dilemma", PA. Concrete Assoc.-/Delaware Valley Masonry Institute, Inc.

Article Entitled, "The Masonry Institute Talks about Steel-Studs and Block Back-Up", PA Concrete Assoc.-/Delaware Valley Masonry Institute, Inc.

Product Literature for: Dryvit System, Inc. (7.13/Dr); Garden State Brickface Co. (7.13/DR); Ispo, U.S.A., Inc. (7.13/DR); Pleko Products.

*Primary Examiner*—James L. Ridgill, Jr.

*Attorney, Agent, or Firm*—Panitch, Schwarze, Jacobs and Nadel

[57] ABSTRACT

An improved back-up wall in building perimeter wall systems that include a porous masonry exterior wall, an interior finished wall and moistureproof to back-up wall separating the two to prevent moisture penetration beyond the exterior wall, is provided by sealing the joints between rigid panels forming the back-up wall with moistureproofing material, building the material up over the seams and reinforcing the seal by embedding a reinforcement strip in the moistureproofing material over the joint. Cost savings and a superior back-up wall can be provided by precoating panels forming the back-up wall with moistureproofing material before installation.

14 Claims, 9 Drawing Figures

WALL SYSTEM CONSTRUCTION, PARTS AND METHODS OF ASSEMBLY

BACKGROUND OF THE INVENTION

There is presently employed a type of three wall construction in low to mid-rise buildings (about ten floors or less) in which brick or masonary veneer wall is backed up with over steel stud mounted dry wall covered with a moisture barrier. An interior dry wall layer forms the third wall. The brick or veneer is typically held to the building by ties extending from interior vertical stringers or is screwed into such stringers. The dry wall back-up is provided as a water, vapor and wind barrier protecting the interior of the building from these environmental conditions. A significant problem associated with this construction is the water permeability of the brick or masonary veneer and corrosion of the brick/veneer attachment hardware. This problem is discussed in an article entitled "Brick Veneer: A Second Opinion", C. T. Grimm, *THE CONSTRUCTION SPECIFIER.* April, 1984.

In addition to the corrosion problems associated with the masonary mounting hardware, I believe there will be a significant corrosion problems associated with the interior steel framing used to mount the dry wall and to hold the brick or masonary veneer as well as damaging moisture penetration due to eventual deterioration of the dry wall back-ups currently being specified and installed. A typical dry wall mounted back-up is provided today by mounting U-shaped galvanized steel channels to the facing upper and lower slab surfaces with power driven steel fasteners, mounting galvanized steel studs at regular intervals (typically 16 inches on center) between the floor and ceiling channel members with sheet metal steel screws and hanging half-inch gypsum board panels to the studs by means of screws or other wallboard fasteners, again typically of steel. The installed gypsum board panels are then typically "dampproofed" by a roofing or dampproofing mechanic who attaches a treated felt paper or trowels a dampproofing mastic over the exterior surface of the panels. Mastic is perceived to be a more effective moisture barrier though more expensive treatment than felt paper which can be torn or pierced in mounting and can separate from adjoining layers. Masons then follow to install the brick or masonary veneer, often puncturing the felt paper or mastic and underlying dry wall with wall ties. An interior dry wall is also hung to the interior sides of the studs supporting the dry wall back-up. Although galvanized steel is generally used, the galvanized surface protection is often abraded when the mounting elements are connected to one another leaving unprotected steel at the critical junction points.

A significant problem with this type of dry wall back-up construction is the high labor cost, particularly that associated with applying the "dampproofing". The installers often must be paid a craftsman wage and the "dampproofing" material must be applied to the entire surface of the installed back-up dry wall by hand.

Yet another problem associated with mastic-type dampproofing systems as currently installed is that no provision is made for eventual deterioration of the mastic between abutting dry wall panels. Typically, the material is applied by hand as quickly as possible with no special treatment being given to the seams between adjoining gypsum board panels. The mastic is simply troweled across the panels and seams between panels.

The thickness of the hand applied coating is never uniform. Typically only a minimum thickness is specified for the wall covering both the gypsum board surfaces and the seams. Asphalt based mastics, which are most commonly specified, can embrittle with curing. The seams between adjoining dry wall panels are also subject to movement due to dynamic flexture of the building under wind loads and, I believe, will eventually cause cracking of the typically thin mastic layer overlapping the seams creating a source for moisture entry. Depending upon the mastic used, temperature fluctuations may also create stresses tending to cause embrittled mastic to eventually crack in the seam areas.

SUMMARY OF THE INVENTION

Primary objects of the invention are the provision of a method of installing a moistureproof back-up or middle wall in a three wall system which is faster than conventional installation of such systems, reduces labor cost at the work site in constructing the system and provides a more uniform, and therefore more predictably effective moistureproofing system.

It is another object of the invention to accomplish the aforesaid primary objects of the invention by the provision and use of wall panels with a moisture proof barrier coating on at least one side thereof.

Other objects of the invention are to provide a more thorough and longer lasting moistureproofing protection to a back-up wall.

It is yet another object to improve the joint sealing of back-up walls.

It is yet another object of the invention to provide a method of moisture proofing back-up walls which are more resistant to cracking from dynamically and/or thermally induced stresses and contraction.

It is yet another object of the invention to provide gasket-like sealing qualities for mounting screws, wall ties and other fasteners passed through the panels forming a moistureproofed. back-up wall.

In accordance with these and other objects, a three wall system is constructed by providing a plurality of metal studs extending between floor and ceiling surfaces of adjoining floor slabs in a multi-story building, near the perimeter of the slabs. An important aspect of the invention is the securing to the metal studs of a plurality of panels each having a rigid support layer and, on a major side of the support layer opposite the metal studs, a preapplied moistureproof covering so as to form a panel wall suspended from the metal studs. "Moistureproofing" as used herein encompasses the blockage of surface water and water vapor but not the blockage of water under any significant hydrostatic head. A conventional masonry outer wall is thereafter constructed adjoining the panel wall and facing the moistureproof covering layer of the panels. The use of pre-coated panels provides a considerable time and labor cost saving as well as a more predictable moistureproofing system. Pre-coated panels also afford some self-protection from rain where the masonary outer wall veneer is not immediately constructed.

According to another important aspect of the invention the moistureproof covering includes a first layer of moistureproof material which is applied directly to the support layer of the back-up wall panel before installation and is of sufficient elasticity and thickness to surround mechanical fasteners, which are passed through the covering and rigid support layers of the panels for attaching the panels to the metal studs, and to form a moistureproof seal around said fasteners to prevent moisture penetration into the rigid support layer of the panel.

According to another aspect of the invention, the moistureproofing covering of the pre-coated panels includes at least a primary layer of non-integral moistureproofing material selected from the group consisting of petroleum components such as bitumen, asphalt and coal tar; synthetic and natural rubber elastomeric and other polymer and polymerized compositions. Non-integral refers to other than solid sheet or film materials.

Another important aspect of the invention is the special treatment given to seams between the panels of the dry wall back-up. The seams are first covered and at least substantially filled with a moistureproofing material to form a moisture barrier. Preferably, the moistureproofing material is built up in a convex configuration over the seams and over the side edge portions of the panels adjoining the seams to provide sufficient material thickness to compensate for cold shrinkage and/or drying. A flexible strip of a suitable reinforcing material such as fiberglass, plastic film, rubberized fabric or the like, is embedded in the moistureproofing material flexed over the seam so as to overlap the seam and adjoining edges of the pairs of adjoining panels on either side of each seam.

These and other advantages of the invention will be apparent to one skilled in the art after a review of the following detailed description and accompanying drawings.

DETAILED DESCRIPTION OF THE INVENTION

Figure 1:
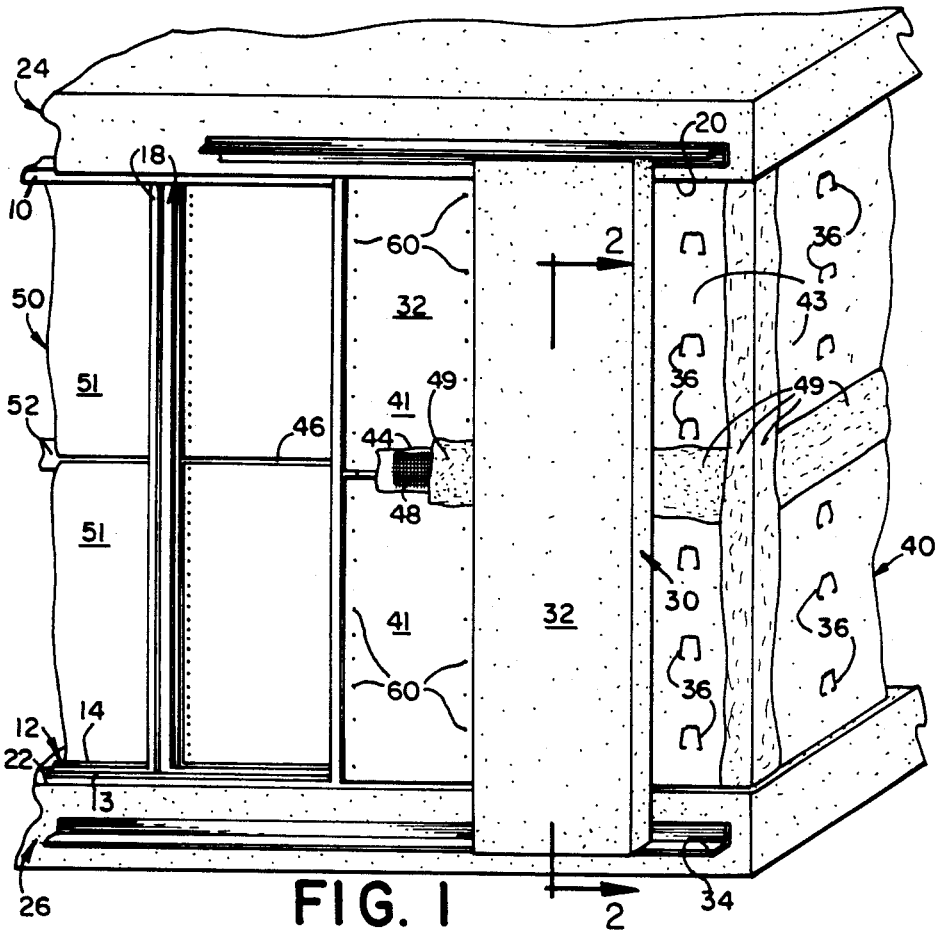
FIG. 1 is a perspective layered view of a three wall construction incorporating a preferred embodiment of the subject invention and sectional to show the individual walls.
Figure 3:
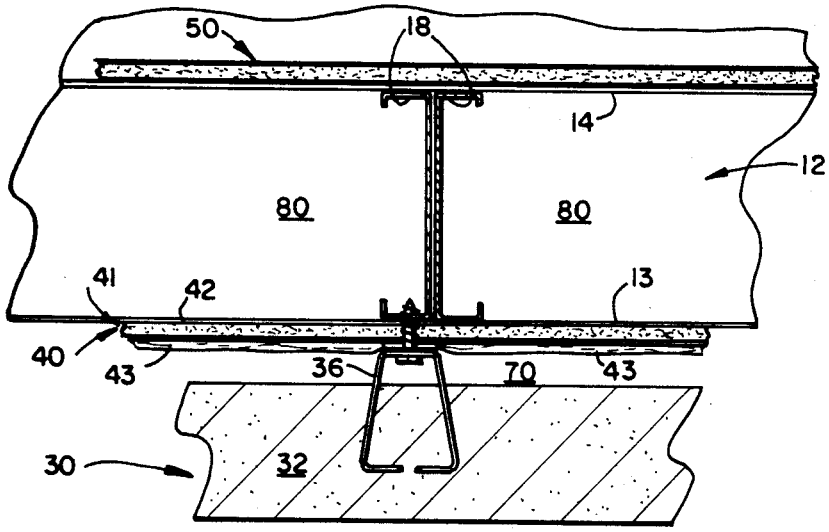
FIG. 3 is a cross-section of the three wall construction along the lines 3—3.
Figure 2:
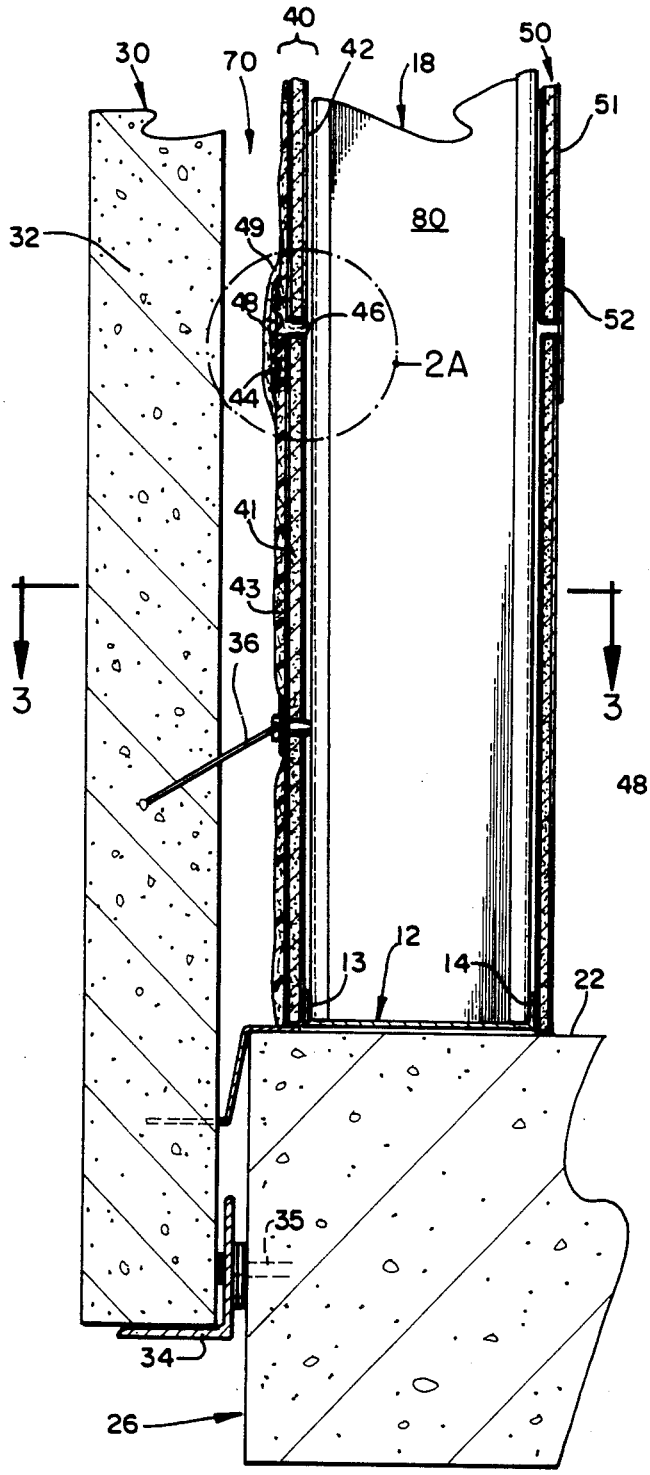
FIG. 2 is a cross-section of the three wall construction along the lines 2—2.

FIG. 1 shows a three perimeter wall type construction incorporating the invention. This type of construction is commonly used in small to medium rise (up to 10 story) buildings. The system includes three independent walls: an outer masonary wall 30, a back-up wall 40 and an interior, finished dry wall 50. As best seen in FIGS. 2 and 3, an air gap 70 is provided between the outer masonary wall 30 and back-up drywall 40. Gaps 80 between the inner two walls 40 and 50 are typically filled with insulation, omitted in the figures for clarity.

Galvanized U-shaped tracks 10 and 12 are attached to the ceiling surface 20 and floor surface 22 of a pair of adjoining concrete floor slabs 24 and 26, respectively, near the outer perimeter of the slabs by conventional means such as a Hilti TM fastening system or other known concrete fastener systems. As best seen in FIG. 3, galvanized U-shaped steel studs 18 are attached in pairs, back to back, spanning the outer and inner arms 13 and 14 respectively of the lower channel section 12 and, identically, arms of the upper channel section 10 (not depicted) and extend between the floor and ceiling surfaces 22 and 20 of the adjoining floor slabs 26 and 24, respectively.

Figure 4:
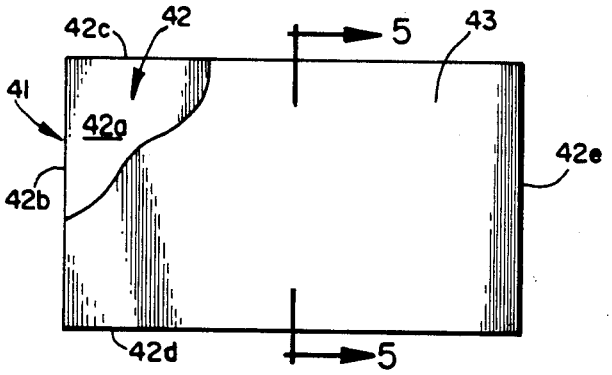
FIG. 4 is a layered elevation view of a preferred panel of the subject invention.
Figure 5:
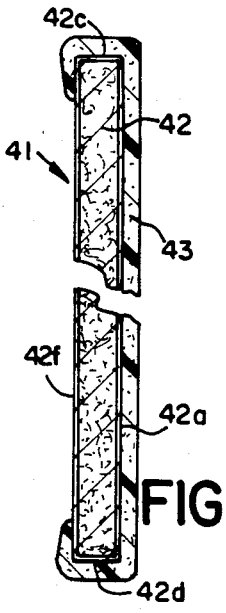
FIG. 5 is a cross-sectional view of the panel of FIG. 4.

According to the preferred construction of the invention, the middle wall 40 is formed first by attaching to the exterior facing sides of the studs 18, panels 41 of the type depicted in FIGS. 4 and 5 having a rigid support layer 42 pre-coated on at least the exterior facing major side surface with a layer of moistureproofing material 43. Conventional means such as screws 60 are used to attach the panels 41 to the metal studs 18. According to the invention, the wall 40 is further moistureproofed by injecting, spreading or otherwise applying a moistureproofing material bead 44 to each seam 46 between adjoining panels 41 so as to create a waterproof and vaporproof seal in the seam. There is no need for this bead 44 to be flush with the exterior major surfaces of the panels 41 or confined to the gap 46 between the panels. Rather, it is suggested that the bead be applied built up over the exterior surfaces of the panel as shown in FIG. 2 to assure that a sufficient volume of moistureproofing material 44 remains in and around the seam 46 after the material has cured to prevent cracking from panel shifting and/or contraction from curing, cooling and/or drying. It is suggested that the bead material have an adhesive character sufficient to assure the material will cling to the vertical panels 43, when applied and to hold reinforcing as will now be explained.

Figure 2A:
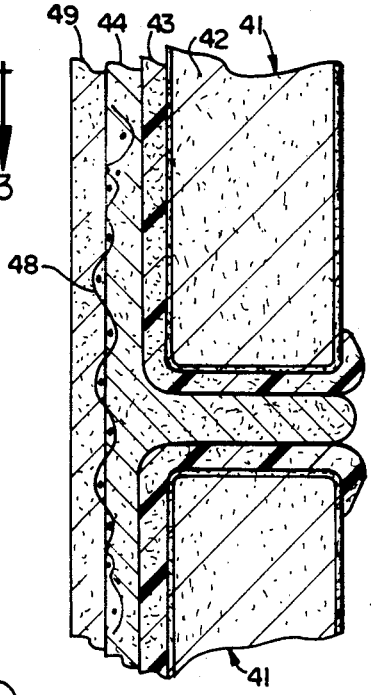
FIG. 2A is an expanded view of A in FIG. 2.

According to an important aspect of the invention, the moistureproofing seals at the seams 46 are reinforced by embedding a strip 48 of flexible reinforcing material, such as moisture permeable fiberglass mesh, moistureproof plastic film, or other material which is non-reactive with the moistureproofing material and unlikely to deteriorate with age, into the moistureproofing material overlying the seam. This can be accomplished by pressing the strip 48 into the material 44 filling seam 46 and into coating 43 at this side edges of adjoining panels 41, if the coating 43 has an adhesive character. Preferably, a separate, additional layer 49 of moistureproofing material, again with an adhesive character, such as a conventional dampproofing or waterproofing mastic, is then applied spanning the seam 46, bead 44, reinforcing strip 48 and adjoining side edges of the adjoining panels 41. If the moistureproof coating 43 of the panels 41 is a plastic film or other material which will not adhere the reinforcement, a different moistureproofing material 44 with an adhesive character, such as conventional building waterproofing mastics which are adhesive at least before they are cured, may be simultaneously applied to the seam and the adjoining edges of the panels as depicted in FIGS. 1 and 2 to adhere the strip 48 to the panels 41. The second layer of moistureproofing material 49 is applied sufficiently thick so as to form, with bead 44 and strip 48, a bulge over each seam 46 extending towards the adjoining masonary wall 30 and overlapping the adjoining panel edges, again to assure an initially excess amount of sealant over the seam 46 to account for future contraction and movement. The embedded reinforcing material should also be installed flexed over the seam 46 to provide slack to accommodate movement of the panels 41. This can be accomplished by mounding the bead 44 over the seam 46 and pressing the strip uniformly into the bead or by pressing the side edges of the reinforcement strip 48 farther into the bead 44 than the center of the strip is pressed, as shown in FIG. 2A.

After the middle wall 40 is constructed and moistureproofed, the outer wall 30 is constructed from a conventional moisture permeable exterior masonary wall material such as brick or pre-cast concrete or brick veneer panels separated from the back-up wall 40 to provide an airspace 70. One such panel 32 is depicted in FIG. 1 suspended from a continuous lintel angle iron 34 attached to a steel member 35 in the floor slab (see FIG. 2). The outer wall 30 may also be formed by such other conventional techniques as laying individual bricks in courses supported by the edge of the floor surface 22 of the lower floor slab 26 or on another support protruding from the face of the floor slab 26 like the angle iron 34. Fasteners such as brick ties 36 are attached to the steel studs 18 through the back-up wall panels 41 to hold the veneer panels 32 (or course of bricks) to the face of the building. The ties 36 are attached after the moistureproofing of the back-up wall 40 has been completed and are a serious potential source of moisture penetration of the back-up wall 40. To minimize the chances of breaking the moisture seal, it is preferred that the moistureproofing coating 43 be of sufficient elasticity and thickness to surround such fasteners and form a moistureproof seal with the fasteners to prevent moisture penetration into the panels 41 as shown in FIG. 3.

Once the panels 41 are hung, the inner wall 50 can be constructed. This wall 50 is conventionally formed by attaching dry wall (i.e. gypsum board) panels 51 to the inner sides of the metal studs 18 by conventional means, such as dry wall screws. The seams between adjoining panels 51 are finished in a conventional manner with wall board tape 52 and overlying grout omitted for clarity. The airspace 80 between the walls 40 and 50 can be filled with insulation, if desired.

FIGS. 4 and 5 depict an envisioned pre-coated back-up dry wall panel 41 for practicing the invention. The panel 41 includes a rigid, supporting layer 42 which is provided by a conventional, inexpensive water or moisture permeable building material. Gypsum board is preferred for cost, and long life but other conventional water/moisture permeable materials such as wood; adhesive wood products such as fiberboard, plywood, etc. or the like may be used. A layer 43 of moistureproofing material is uniformly applied to one major side surface 42*a* of the support panel 42. Preferably, the layer 43 also extends around the narrow side edges 42*b* through 42*e* to help seal the seam area between panels and protect the edges of the remaining panels. While plastic film and sheet coated panels are available for other purposes and might be used for back-up moistureproofing, non-integral (i.e., other than solid film or sheet) coatings which can be applied by trowel (or other spreading menas)w brush or spray can also be used to precoat panels to provide moistureproof backup. Conventional petroleum component dampproofing or waterproofing compositions, such as Karnac Chemical Corp. No. 86 (fibrated asphalt mastic), No. 920 (fibrated asphalt emulsion mastic) applied in a minimum thickness of about 0.030 inches or more are preferred for cost and for providing a relatively thick, elastic coating which will be displaced by and subsequently retract around fasteners passed through the coating, forming a seal with the fasteners. A wide variety of other non-integral waterproofing and dampproofing compositions exist which would be suitable for preapplication to conventional, water permeable, building material panels to provide a back-up wall system and which would provide a more uniform and thus superior moistureproofing system to the on-site hand applied systems presently used. In addition to petroleum component based compositions (i.e. asphalt, bitumen, tar, etc. and compositions thereof like the Karnak Chemical Corporation compositions) these include, but are not limited to, synthetic and natural rubber based compositions including those based on latex, butyl and/or neoprene; silicone compositions; and conventional film forming polymer systems such as polyesters or polymers of ethylenically-unsaturated monomers, which may or may not be cross linkable, and other like spreadable, brushable or sprayable liquid or solid compositions well known in the construction trade and conventionally used for moistureproofing or waterproofing roofs and/or foundations. Such compositions are found and described in references commonly used in the trade such as the current and earlier annual editions of Sweet's Catalog File, Products for General Building, particularly sections 7.9 waterproofing and dampproofing, 7.11 sealants, 7.12 traffic topping, 7.15 roofing insulation, 7.17 vapor barriers/retardants, and 7.18 air infiltration barriers.

Trowable mastics such as the aforesaid Karnak 86 and 920 compositions can be applied in a uniform thickness by passing a panel with such material spread across it beneath a straight edge, fixed roller or the like. A pressurized feed system can be provided to automatically feed the material across the panel before passing under the edge or roller. Sprayable or brushable materials such as Karnak 220 may be applied to panels passed by one or more sprayheads or brushheads at a speed calculated to provide desired thickness.

Figure 6:
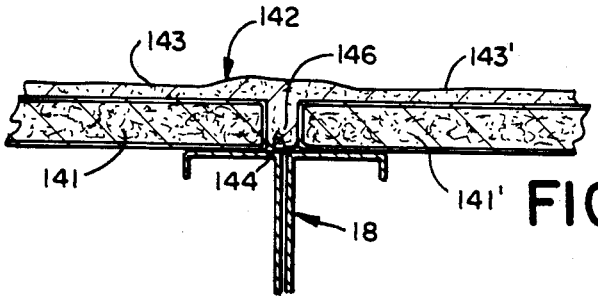
FIGS. 6 through 8 are cross-sectional views of a seam between a pair of adjoining drywall panels.
Figure 7:
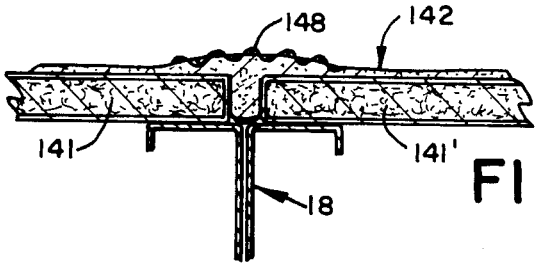
Figure 8:
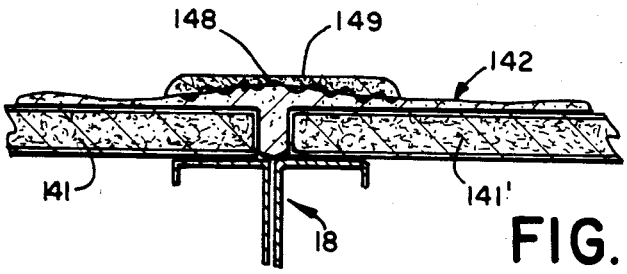

While it is preferred that the moistureproofing material be preapplied to the dry wall back-up panels before installation, some improvement can be obtained with conventional methods of installing unprotected gypsumboard and subsequent application of moistureproofing materials by paying greater attention to the sealing of seams between the wallboard panels. The seams also deserve special attention even when pre-coated panels of the subject invention or other moistureproof panel systems are used. FIGS. 6 through 8 show the suggested steps for improving the moistureproofing characteristic of the seams of a conventional back-up dry wall. As is depicted in FIG. 6, moistureproofing material 143 preferably one with some elastic and adhesive qualities such as the aforesaid Karnac No. 86 or No. 920 or the like, is applied to the exposed side of each panel 41 and 41' opposite the stud 18 and pressed into the seam 144 between adjoining side edges of adjoining panels 141 and 141', preferably filling the seam 144 as shown. A moistureproofing material a layer 142 covers a major planner surface 143 and 143 of each dry wall panel 141 and 141', respectively, as well as a moistureproof plug filling the seam 144. Preferably, the moistureproofing material is thicker over the seam 144 and adjoining side edges of the panels 141 and 141' than over the remainder of the panels. Next, as is depicted in FIG. 7, a reinforcing flexible strip 48 of material, such as a 6 inch or preferably 8 inch wide strip of open mesh fiberglass cloth is pressed into the moistureproof material spanning the seam 114 and side edges of the panels 141 and 141' adjoining the seam 144. The waterproofing material over and around the seam 144 should be contoured or the side edges of the strip 48 should be pressed deeper into the coating 14 to cause the reinforcing material strip 48 to be flexed over the seam 144 to allow for motion of the panels 141 and 141' and contraction of the material. As is depicted in FIG. 8, a second layer 147 of moistureproofing material is applied covering and "encapsulating" the flexible strip 48, the underlying seam 146 and adjoining side edges of the panels 141 and 141' and, preferably, is applied sufficiently thick so as to distinctly bulge outwardly from the remainder of the material 143 remote from the seam 144. Total thickness of moistureproofing material over the seam including the reinforcing strip should be at least double and preferably at least triple the thickness of the moistureproofing coating over the remainder of the panels.

While preferred and other embodiments of my invention have been described and variations thereto suggested, other variations of the invention will occur to those familiar with this area of construction. The invention is not intended to be limited to the particular embodiments described and suggested but to all embodiments encompassed by the following claims.

I claim:

1. In a three wall system installed near an outer perimeter of a multi-story building comprising a moisture permeable inner wall, a moisture permeable masonry outer wall exposed to the elements and a middle wall formed of moisture permeable rigid adjoining panels the improvement comprising:

moistureproofing material means covering the outer wall facing side of said rigid panels and covering and at least partially filling the seams between adjoining pairs of said panels sufficiently for closing said rigid panels and said seams to water and vapor passage; and flexible strip means embedded in said moistureproofing material means overlying said seams and adjoining edges of said pairs of adjoining panels on either side of said each of said seams for supporting said moistureproofing material means over said seams.

2. The improvement of claim 1 wherein said covering includes a layer of material of sufficient elasticity and thickness to surround the fasteners that pass through said covering into said panels and form a seal with said fasteners to prevent water and vapor penetration into said panels.

3. The improvement of claim 1 wherein the moistureproofing material means includes a layer of moistureproofing material selected from the group consisting of bitumenous resins and compositions thereof, synthetic rubber compositions, natural rubber compositions, and polymer and copolymer elastomeric compositions.

4. The improvement of claim 1 wherein said flexible strip means is flexed over the underlying seam.

5. The improvement of claim 4 wherein said moistureproofing material means is thicker over said seams and said adjoining panel edges than over the remainder of said panels.

6. The improvement of claim 1 wherein said moistureproofing material means includes a layer of moistureproofing material of uniform thickness on said outer wall facing side of said panels and an additional layer of a moistureproofing material over only said flexible strip means and the seam and side edges of the panels adjoining the seam.

7. The improvement of claim 6 wherein the moistureproofing material of the layer is different from the moistureproofing material of the additional layer.

8. A method of exterior wall construction in multifloor buildings comprising the steps of:

installing a plurality of vertical studs extending between adjoining floor slabs;

securing a plurality of rigid panels to the studs to form a wall of adjoining panels;

applying a moistureproofing material to seams between adjoining panels;

applying to the seams between adjoining panels over the moistureproofing material and to side edges of the panels adjoining the seams, a flexible reinforcement material; and constructing a masonry wall adjoining the exterior facing major sides of said panels and an interior drywall adjoining the interior facing major sides of the panels.

9. The method of claim 3 wherein said step of applying a flexible reinforcement material further includes the step of flexing the flexible reinforcement material over the seam when applying the reinforcement material to accommodate movement of the panels adjoining the seams.

10. The method of claim 8 further including between said second applying step and said constructing step the step of applying a second layer of moistureproofing material over said flexible reinforcement material and the underlying seam while leaving the major portion of the exterior facing major side of each panel free of said second layer.

11. A method of exterior wall construction in multifloor buildings comprising the steps of:

installing a plurality of vertical studs extending between the facing floor and ceiling surfaces of adjoining floors of the building;

securing to the studs a plurality of panels each having a rigid support layer and on a major side surface of the support layer opposite the metal studs a preapplied moistureproof coating to form a wall of precoated moistureproofed panels; and constructing a masonry wall spaced from and adjoining an exteior facing side of said plurality of panels and moistureproof coating layer of said panels and a drywall spaced from and adjoining an opposing, interior facing side of said panels.

12. The method of claim 11 further comprising the steps of:

applying a flexible reinforcing material strip over seams between adjoining panels spanning the seams and side edges of the panels adjoining the seams; and applying another coating of moistureproofing material to the panel wall in the vicinity of the seams overlying the flexible reinforcing material, underlying seam and adjoining side edges of the panels adjoining the seam.

13. The method of claim 12 further comprising before the step of applying the flexible reinforcing material, the step of:

applying a layer of moistureproofing material to the seams between adjoining panels to form a moistureproof seal between each pair of adjoining panels.

14. The method of claim 12 wherein moistureproof material over the seams is thicker than moistureproof material over the major portion of the major side surface of the panels.

* * * * *